US009539631B2

(12) United States Patent
Shaska et al.

(10) Patent No.: US 9,539,631 B2
(45) Date of Patent: Jan. 10, 2017

(54) MANUFACTURING PROCESS FOR TUBE-IN-TUBE INTERNAL HEAT EXCHANGER

(71) Applicant: Halla Visteon Climate Control Corp., Daejeon (KR)

(72) Inventors: Kastriot Shaska, Northville, MI (US); Radim Cech, Studenka (CZ); Pavel Segeta, Stary Jicin (CZ); Zbynek Trncak, Koprivnice (CZ); Pavel Cebe, Roznov pod Radhostem (CZ)

(73) Assignee: HANON SYSTEMS, Daejeon-Si (KR)

( * ) Notice: Subject to any disclaimer, the term of this patent is extended or adjusted under 35 U.S.C. 154(b) by 102 days.

(21) Appl. No.: 14/163,020

(22) Filed: Jan. 24, 2014

(65) Prior Publication Data

US 2015/0075247 A1 Mar. 19, 2015

Related U.S. Application Data

(60) Provisional application No. 61/877,343, filed on Sep. 13, 2013.

(51) Int. Cl.
*B21D 53/06* (2006.01)
*B21D 7/028* (2006.01)
(Continued)

(52) U.S. Cl.
CPC ..... *B21D 7/028* (2013.01); *B21D 53/06* (2013.01); *F28D 7/106* (2013.01); *B21D 15/02* (2013.01)

(58) Field of Classification Search
CPC ..... B21D 7/024; B21D 7/00; B21D 7/02; B21D 7/06; B21D 7/066; B21D 7/021; B21D 7/028; B21D 7/03; F28D 1/0477;F28D 1/0478; F28F 1/006; F28F 1/025; Y10T 29/49391
See application file for complete search history.

(56) References Cited

U.S. PATENT DOCUMENTS 4,137,743 A * 2/1979 Schwarze ..... B21D 9/073 29/455.1
9,091,487 B2 * 7/2015 Byon ..... F28D 7/106
(Continued)

FOREIGN PATENT DOCUMENTS

CN 201264059 Y 7/2009
EP 2228613 A2 9/2010
(Continued)

OTHER PUBLICATIONS

Cited abstract JP60166124A is attached.*

*Primary Examiner* — Peter DungBa Vo
*Assistant Examiner* — John S Lowe
(74) *Attorney, Agent, or Firm* — Fraser Clemens Martin & Miller LLC; James D. Miller

(57) ABSTRACT

A method of bending a tube arrangement including an inner tube disposed within an outer tube is performed using a bending die having a concave groove including a curved portion extending around a peripheral surface of the bending die, the curved portion of the concave groove having at least one ridge projecting therefrom. The tube arrangement is located within the concave groove and a force is applied to the tube arrangement in a direction toward the curved portion of the bending die to cause the tube arrangement to conform to the shape of the concave groove. The at least one ridge projecting from the concave groove causes the outer tube to deform such that an interior surface of the outer tube contacts an exterior surface of the inner tube, securing a position of the inner tube within the outer tube.

14 Claims, 5 Drawing Sheets

(51) Int. Cl.
*F28D 7/10* (2006.01)
*B21D 15/02* (2006.01)

(56) References Cited

U.S. PATENT DOCUMENTS

| | | | | |
|---|---|---|---|---|
| 2007/0221365 | A1* | 9/2007 | Martin | B21D 7/024<br>165/150 |
| 2010/0230082 | A1* | 9/2010 | Patel | B21D 15/02<br>165/177 |

FOREIGN PATENT DOCUMENTS

| | | | | |
|---|---|---|---|---|
| JP | 60166124 | A | * | 8/1985 |
| JP | S60186124 | A | | 8/1985 |
| JP | 2001-269721 | A | | 10/2001 |
| JP | 2001323814 | A | | 11/2001 |
| JP | 2005098494 | A | | 4/2005 |
| JP | 2006153244 | A | | 6/2006 |
| JP | 2009255115 | A | | 11/2009 |
| JP | 2011027396 | A | | 2/2011 |

* cited by examiner

MANUFACTURING PROCESS FOR TUBE-IN-TUBE INTERNAL HEAT EXCHANGER

CROSS-REFERENCE TO RELATED APPLICATIONS

This application claims priority to U.S. Provisional Application Ser. No. 61/877,343, filed Sep. 13, 2013, the entire disclosure of which is hereby incorporated herein by reference.

FIELD OF THE INVENTION

The invention relates to a method of manufacturing a tube arrangement for use in an internal heat exchanger, and more specifically, to a method of bending the tube arrangement using a bending die.

BACKGROUND OF THE INVENTION

The Internal Heat Exchanger (IHX) has become an increasingly common component of motor vehicle air conditioning systems. The IHX is used to increase an operating efficiency of a standard refrigeration cycle for use in an air conditioning system. A standard refrigeration cycle includes a compressor, a condenser, a thermal expansion device, and an evaporator. The IHX is a liquid-to-vapor heat exchanger having an inner channel disposed within an outer channel. A refrigerant used in the refrigeration cycle exits the condenser as a hot liquid and flows through one of the channels as the same refrigerant exits the evaporator as a cool vapor refrigerant that flows through the other channel. The IHX transfers additional heat from the hot liquid refrigerant to the cool vapor refrigerant, cooling the liquid refrigerant below its condensation temperature, also referred to as "sub-cooling." This cooling of the liquid refrigerant before it reaches the thermal expansion device causes the IHX to utilize cooling capacity that would otherwise be wasted.

One form of the IHX is a tube-in-tube heat exchanger. The tube-in-tube heat exchanger utilizes a tube arrangement having an inner tube disposed co-axially within an outer tube, the interior surface of the inner tube defining a first flow channel while an exterior surface of the inner tube cooperates with an interior surface of the outer tube to form a second flow channel. The cool vapor refrigerant flows through the first flow channel while the hot liquid refrigerant flows through the second channel. Heat is exchanged between the first flow channel and the second flow channel via the wall of the inner tube, which is heat conductive. The tube-in-tube heat exchanger is advantageous because it requires no moving parts, causing the tube-in-tube heat exchanger to rarely require repair or replacement.

Because the tube-in-tube heat exchanger includes a co-axial tube-in-tube configuration, the capacity of the tube-in-tube heat exchanger to exchange heat between the hot liquid refrigerant and the cool vapor refrigerant is directly affected by a length of the co-axial tubes forming the tube-in-tube heat exchanger. Co-axial tubes having a greater length aid the efficiency and cooling capacity of the IHX because the greater length exposes a greater surface area available for heat exchange between the two flow channels formed by the inner tube and the outer tube. However, space constraints present in a vehicle body housing the tube-in-tube heat exchanger often prevents the tube-in-tube heat exchanger from being formed as a single linear leg of tubing. Instead, it has been found that introducing several bends to the tube-in-tube heat exchanger may aid in resolving size constraints, allowing a shape of the tube-in-tube heat exchanger to be adapted to various configurations of adjacent components present within the vehicle.

When forming a bend in a portion of a tube-in-tube heat exchanger, it is preferable to maintain a relatively constant cross-sectional profile of the inner tube relative to the outer tube. However, the process of bending the tube arrangement often results in a warping of the tubes. Specifically, when bent, such tubes tend to take on an oval shape, with a cross-section of the tubes becoming elongated in a direction parallel to an axis of rotation of the tube arrangement as it is bent. In some cases, the warping of the tubes may lead to a collapse of one of the tubes forming the tube-in-tube heat exchanger. The collapse results in a cross-section of the tube taking on a D-shape, with the flattened portion of the D-shape being formed on an inner surface of the bend formed in the tube arrangement.

The presence of a D-shaped collapse in one or both of the tubes forming the tube-in-tube heat exchanger is problematic for several reasons. First, a collapse of both the inner tube and the outer tube results in both tubes having the generally D-shaped cross-section. The generally flat portions of the D-shaped cross-sections tend to contact each other or be in close proximity due to the deformation of both tubes. Vibrations caused by operation of the motor vehicle may cause these flat portions to rattle against each other, causing undesirable noise to be generated within the tube-in-tube heat exchanger. Second, the undesirable deformation of the inner and outer tubes may cause the first and second flow channels to become obstructed, narrowed, or widened undesirably in certain regions, potentially leading to flow restrictions, pressures losses, or regions of inefficient heat transfer.

One method of avoiding the collapse of the tube arrangement has been to preform the tubes forming the tube arrangement to already have the bends present therein rather than applying a force to bend an already assembled tube arrangement. However, such preforming methods often add excessive cost and complexity to the manufacturing process.

It would therefore be desirable to develop a method of bending a tube arrangement having an inner tube disposed within an outer tube that prevents collapse of the tubes forming the tube arrangement while also minimizing a restriction of the flow channels formed by the inner tube and the outer tube.

SUMMARY OF THE INVENTION

Compatible and attuned with the present invention, a method of bending a tube arrangement having an inner tube disposed within an outer tube that prevents a collapse of one or both tubes while securing a position of the inner tube within the outer tube is surprisingly discovered.

In one embodiment of the invention, a method of forming a bend in a tube arrangement is disclosed. The method comprises providing a tube arrangement and a bending die. The tube arrangement includes an inner tube disposed within an outer tube. The bending die has a concave groove formed therein. The concave groove includes a curved portion extending around a peripheral surface of the bending die, the curved portion of the concave groove having at least one ridge projecting therefrom. The method further includes locating at least a portion of the tube arrangement within the concave groove of the bending die and applying force to the tube arrangement in a direction toward the concave groove of the bending die to cause the tube arrangement to bend around the curved portion of the concave groove.

In another embodiment of the invention, a method of bending a tube arrangement around a bending die is disclosed. The method comprises providing a bending die and a tube arrangement. The bending die has a concave groove formed therein, the concave groove having at least one ridge projecting therefrom. The tube arrangement includes an inner tube disposed within and outer tube. The outer tube of the tube arrangement is deformed to conform to a shape of the concave groove having the at least one ridge projecting therefrom as the tube arrangement is bent around the bending die.

In yet another embodiment of the invention, a bending die for use in bending a tube arrangement is disclosed, the bending die comprising a substantially U-shaped die having a concave groove formed around a peripheral surface thereof, the concave groove having a substantially semi-circular profile and at least one ridge projecting outward from a surface thereof.

BRIEF DESCRIPTION OF THE DRAWINGS

The above, as well as other objects and advantages of the invention, will become readily apparent to those skilled in the art from reading the following detailed description of a preferred embodiment of the invention when considered in the light of the accompanying drawing which.

DETAILED DESCRIPTION OF THE INVENTION

The following detailed description and appended drawings describe and illustrate various embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1A:
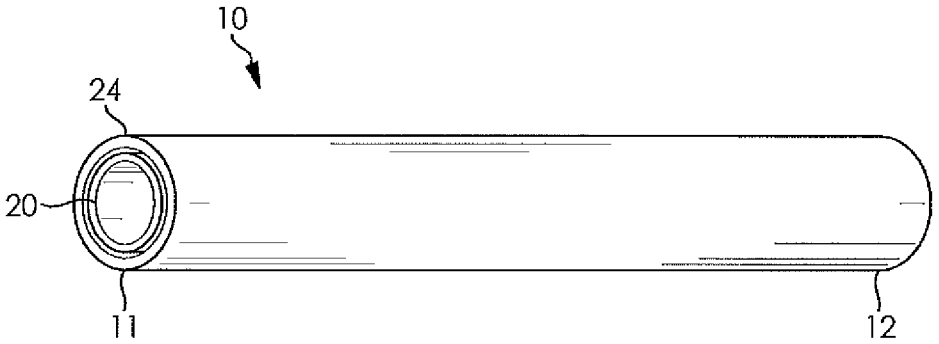
FIG. 1A is a perspective view of a tube arrangement including an inner tube disposed within an outer tube.
Figure 1B:
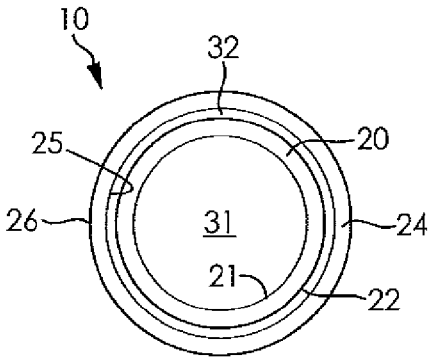
FIG. 1B is a cross-sectional view of the tube arrangement of FIG. 1A.

FIGS. 1A and 1B show a tube arrangement 10 for use in an internal heat exchanger. The internal heat exchanger may be suitable for use in an air conditioning system of a motor vehicle. The tube arrangement 10 includes an inner tube 20 disposed within an outer tube 24. Both the inner tube 20 and the outer tube 24 are hollow and cylindrical prior to being bent or otherwise altered. As most clearly shown in FIG. 1A, the inner tube 20 and the outer tube 24 are substantially concentric. The inner tube 20 includes an interior surface 21 and an exterior surface 22 and the outer tube 24 includes an interior surface 25 and an exterior surface 26, where each surface 21, 22, 25, 26 extends along a length of each one of the respective tubes 20, 24. The exterior surface 26 of the outer tube 24 has a substantially circular cross-section as shown FIG. 1A, with a radius of curvature of the exterior surface 26 measured from a central point of the concentric inner and outer tubes 20, 24. However, the exterior surface 26 of the outer tube 24 may have an elliptical or elongated cross-section without departing from a scope of the current invention.

The interior surface 21 of the inner tube 20 defines a first flow channel 31 within the inner tube 20. The exterior surface 22 of the inner tube 20 cooperates with the interior surface 25 of the outer tube 24 to form a second flow channel 32 between the inner tube 20 and the outer tube 24. Because the inner tube 20 and the outer tube 24 are concentric, the exterior surface 22 of the inner tube 20 is substantially equally spaced from the interior surface 25 of the outer tube 24 around a circumference of each of the inner tube 20 and the outer tube 24.

The concentric arrangement and substantially equal spacing between the inner tube 20 and the outer tube 24 is maintained by using any known method, including crimping the inner tube 20 to the outer tube 24 adjacent at least one of a first longitudinal end 11 and a second longitudinal end 12 of the tube arrangement 10. Alternatively, an insert or other form of spacer may be placed between the exterior surface 22 of the inner tube 20 and the interior surface 25 of the outer tube to maintain the substantially equal spacing between the tubes 20, 24. It should be understood that any method of spacing or joining the tubes 20, 24 is typically applied to those portions of the tube arrangement 10 not subject to bending or any other form of deformation, such as the longitudinal ends 11, 12 of the tube arrangement 10.

The inner tube 20 and the outer tube 24 may be formed from the same material or different materials. The material forming the tubes 20, 24 should be selected to have properties such as ductility suitable for deforming the tube arrangement 10 during a bending process without a failure of the material. The material should also be non-corrosive to avoid degradation due to extended use with a fluid, such as a refrigerant, that may be caused to flow through the first flow channel 31 and the second flow channel 32. The material of the inner tube 20 may also be selected to have a suitable thermal conductivity to facilitate a fluid flowing in the first flow channel 31 to exchange heat with a fluid flowing in the second flow channel 32. The material may also be selected to have strength suitable for withstanding any internal pressures that may be present within either of the flow channels 31, 32. A suitable material may be aluminum, for example. However, it should be understood that any material having the appropriate properties may be selected.

Figure 2A:
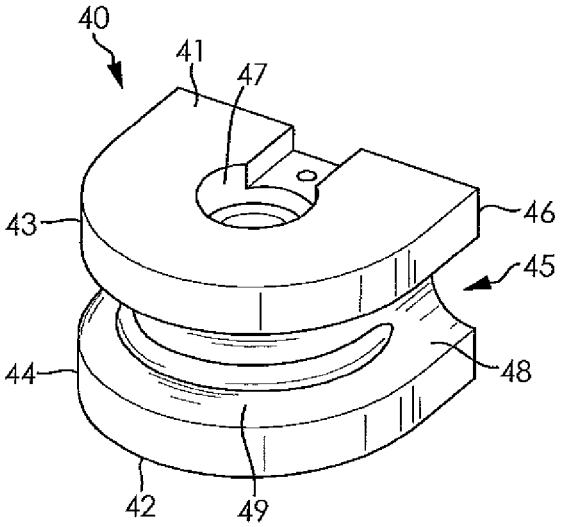
FIG. 2A is a perspective view of a bending die used to bend the tube arrangement of FIGS. 1A and 1B.

FIG. 2A shows a bending die 40 used to bend the tube arrangement 10. The bending die 40 has a first surface 41 that is arranged substantially parallel to and opposite a second surface 42 thereof. The first surface 41 and the second surface 42 also have a substantially U-shaped cross-section and are substantially aligned with each other in a vertical direction. A substantially planar back surface 46 is arranged substantially perpendicular to and connects the first surface 41 and the second surface 42 of the bending die 40. The bending die 40 includes a substantially U-shaped peripheral surface opposite the back surface 46 that may be divided into an first peripheral surface 43 extending substantially perpendicular to and downward from a peripheral edge of the first surface 41 as well as a second peripheral surface 44 extending substantially perpendicular to and upward from a peripheral edge of the second surface 42. The first peripheral surface 43 and the second peripheral surface 44 terminate on each side of the bending die 40 at the back surface 46 thereof. The first peripheral surface 43 is substantially parallel to and aligned with the corresponding second peripheral surface 44 around the U-shaped portion of the bending die 40. The bending die 40 may further include an aperture 47 formed therein. The aperture 47 may extend through the bending die 40 from the first surface 41 to the second surface 42 thereof. The aperture 47 may receive a rotor (not shown) or other shaft to cause or allow rotational motion of the bending die 40 during a bending operation. The aperture 47 may also include a slot extending towards the back surface 46 of the bending die 40.

The bending die 40 also includes a concave groove 45 formed between the first peripheral surface 43 and the second peripheral surface 44 around the U-shaped portion of the bending die 40. The concave groove 45 may include a linear portion 48 at each terminal end thereof adjacent the back surface 46 of the bending die 40. The linear portions 48 of the concave groove 45 surround a curved portion 49 of the concave groove 45 extending from one of the linear portions 48 to the other of the linear portions 48, the curved portion 49 formed opposite the back surface 46 of the bending die 40. As shown in FIG. 2A, the curved portion 49 of the concave groove 45 extends about 180° around the periphery of the bending die 40, causing the concave groove 45 to follow a semi-circular path opposite the back surface 46 of the bending die 40. However, it should be understood that the bending die 40 may include a curved portion 49 that extends around any angle of the periphery of the bending die 40, depending on the application and form of the bend to be applied to the tube arrangement 10. A radius of curvature of the concave groove 45 is measured from a center of the aperture 47 formed within the bending die 40 to a surface of the concave groove 45.

The concave groove 45 has a substantially semi-circular profile along the linear portions 48 thereof. The linear portions 48 of the concave groove 45 are dimensioned to substantially conform to and receive at least a portion of the exterior surface 26 of the outer tube 24 therein. Accordingly, a distance between the first peripheral surface 43 and the second peripheral surface 44 defining a diameter of the concave groove 45 is substantially the same or slightly larger than a diameter of the exterior surface 26 of the outer tube 24. Similarly, a radius of curvature of the profile of the concave groove 45 substantially corresponds to the radius of curvature of the exterior surface 26 of the outer tube 24.

Figure 2B:
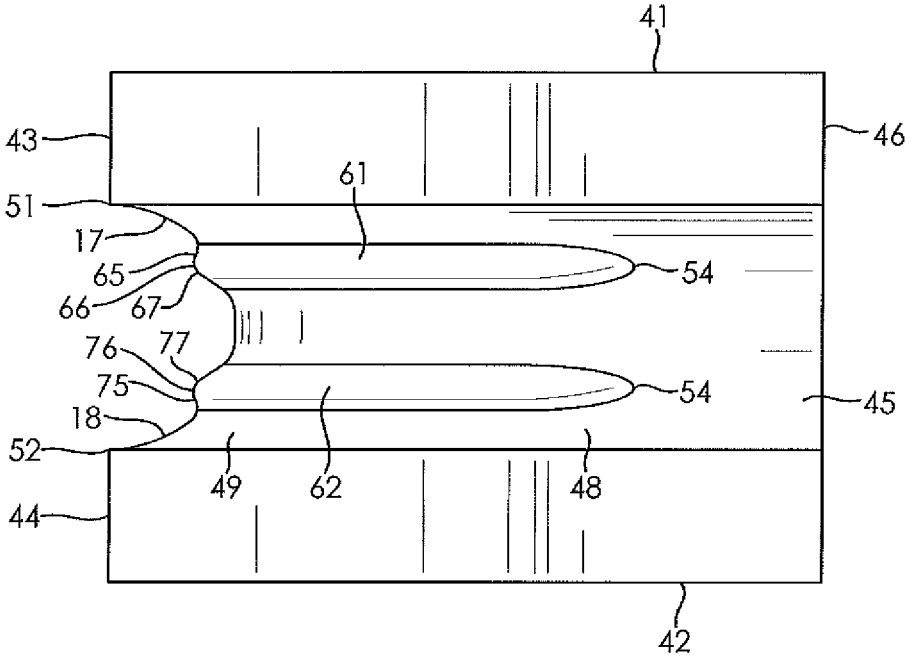
FIG. 2B is a right side elevational view of the bending die of FIG. 2A.

As shown in FIG. 2B, the concave groove 45 also has a substantially semi-circular profile along the curved portion 49 of the concave groove 45. However, the curved portion 49 of the concave groove 45 also includes a first ridge 61 projecting from a first surface 17 of the concave groove 45 and a second ridge 62 projecting from a second surface 18 of the concave groove 45. The first surface 17 covers a 90° arc forming the profile of the concave groove 45 adjacent the first peripheral surface 43 of the bending die 40 and the second surface 18 covers a 90° arc forming the profile of the concave groove 45 adjacent the second peripheral surface 44 of the bending die 40. As shown in FIGS. 2A and 2B, the first ridge 61 and the second ridge 62 begin adjacent a transition from the linear portion 48 of the concave groove 45 to the curved portion 49 thereof, causing each ridge 61, 62 to extend around the curved portion 49 of the bending die 40 about 180°. As best shown in FIG. 2B, a terminal end of each ridge 61, 62 has a triangular appearance due to each ridge 61, 62 having an origin 54 from which each ridge 61, 62 begins to widen and project away from the surface of the concave groove 45. Each of the ridges 61, 62 reaches a maximum width and distance projected from the surfaces 17, 18 of the concave groove 45 adjacent a transition from the linear portion 48 of the concave groove to the curved portion 49 thereof. However, it should be understood that the ridges 61, 62 may project from the concave groove 45 along any length or portion of the concave groove 45 depending on the desired bend. It should also be understood that absent the ridges 61, 62 formed therein, the profile of the concave groove 45 along the curved portion 49 thereof has a diameter and a radius of curvature substantially corresponding to the diameter and the radius of curvature of the exterior surface 26 of the outer tube 24.

Figure 2C:
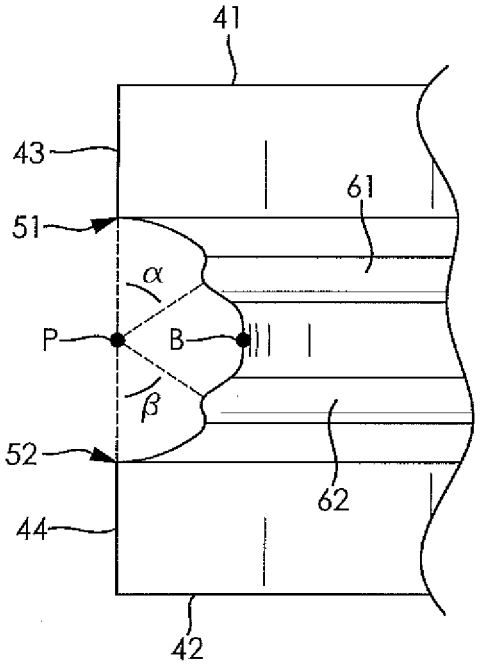
FIG. 2C is an enlarged fragmentary elevational view of the bending die of FIG. 2B.

The position of each ridge 61, 62 may be defined by determining an angular displacement of each ridge 61, 62 along an arc forming the profile of the concave groove 45. Referring now to FIG. 2C, a point P is disposed directly between a first edge 51 formed between the first peripheral surface 43 and the concave groove 45 and a second edge 52 formed between the second peripheral surface 44 and the concave groove 45. The radius of curvature of the profile of the concave groove 45 is measured from the point P to a surface of the concave groove 45 not including the ridges 61, 62 projecting therefrom. The profile of the concave groove 45 follows a 180° arc extending from the first edge 51 to the second edge 52. A point B is located on the profile of the concave groove 45 between the first and second edges 51, 52 and in horizontal alignment with the point P, dividing the first surface 17 from the second surface 18 of the concave groove 45. Accordingly, the point B is disposed about 90° along the arc forming the profile of the concave groove 45 from each of the first and second edges 51, 52. The position of the first ridge 61 is determined by following the arc forming the cross-sectional profile of the concave groove 45 through an angle $\alpha$ from the first edge 51 and toward the point B. The position of the second ridge 62 is determined by following the arc forming the cross-sectional profile of the concave groove 45 through an angle $\beta$ from the second edge 52 and toward the point B. As shown in FIG. 2C, the angle $\alpha$ is about 45°, indicating that the first ridge 61 is disposed about 45° from the first edge 51 along the arc forming the profile of the concave groove 45. Similarly, the angle $\beta$ is about 45°, indicating that the second ridge 62 is disposed about 45° from the second edge 52 along the arc forming the profile of the concave groove 45.

It should be understood that the first ridge 61 and the second ridge 62 may be disposed anywhere along the arc forming the profile of the concave groove 45. For example, the angles $\alpha$ and $\beta$ may typically each measure between 30° and 60°. As explained hereinafter, it may also be preferable for the angles $\alpha$ and $\beta$ to be equal, allowing for a symmetric profile of the curved portion 49 of the concave groove 45 when mirrored about the point B.

Referring again to FIG. 2B, each of the first ridge 61 and the second ridge 62 has a generally triangular profile as each ridge 61, 62 projects away from the first and second surfaces 17, 18 of the concave groove 45, respectively. The first ridge 61 includes an outer slope 65 and an inner slope 67 extending from the first surface 17 of the concave groove 45. The outer and inner slopes 65, 67 of the first ridge 61 join at a first crest 66. The second ridge 62 also includes an outer slope 75 and an inner slope 77 extending from the second surface 18 of the concave groove 45. The outer and inner slopes 75, 77 of the second ridge 62 join at a second crest 76. The outer slope 65 of the first ridge 61 is formed to a side of the first crest 66 adjacent the first edge 51, the outer slope 75 of the second ridge 62 is formed to a side of the second crest 76 adjacent the second edge 52, and the inner slopes 67, 77 are formed adjacent to each other in a central region of the profile of the concave groove 45.

As shown in FIG. 2B, the first crest 66 projects laterally from the concave groove 45 beyond the inner slope 65 and the outer slope 67 of the first ridge 61. Similarly, the second crest 76 projects laterally from the concave groove 45 beyond the inner slope 75 and the outer slope 77 of the second ridge 62. The inner slopes 67, 77 are arranged at an angle relative to horizontal that is shallower than an angle relative to horizontal of the outer slopes 65, 75. As shown in FIG. 2B, the arrangement of the inner slope 65 and the outer slope 67 of the first ridge 61 causes the first crest 66 to point in a direction having a downward component while the arrangement of the inner slope 75 and the outer slope 77 of the second ridge 62 causes the second crest 76 to point in a direction having an upward component.

The bending die 40 may be formed from any material capable of resisting deformation during a bending of the tube arrangement 10. Accordingly, the bending die 40 may be formed from hardened steel or tooling steel. However, it should be understood that any appropriate material may be used to form the bending die 40.

Figure 3:
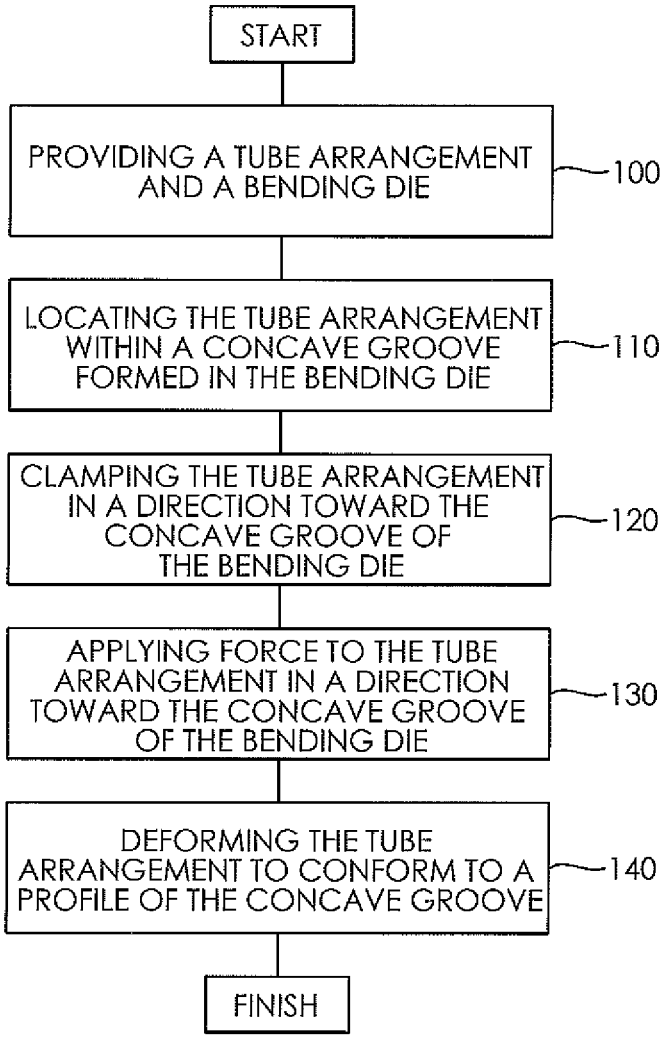
FIG. 3 is a flow diagram illustrating a method of bending the tube arrangement according to one embodiment of the invention.

FIG. 3 is a flow diagram illustrating the steps comprising a method of bending the tube arrangement 10 according to the invention. A first step 100 according to the method includes providing the tube arrangement 10 having the inner tube 20 disposed within and concentric with the outer tube 24 as well as the bending die 40 having the concave groove 45 dimensioned to receive the exterior surface 26 of the outer tube 24 therein. Following the providing step 100, the tube arrangement 10 and the bending die 40 are ready for a bending process.

It should be understood that the bending die 40 may be adapted for use with any known tube or pipe bending devices that utilize a bending die, including devices that are human powered, pneumatic powered, hydraulic assisted, hydraulic driven, or electric servomotor driven, for example. The bending die 40 may be adapted for use in a press bending process or a rotary draw bending process. The bending die 40 may be most suitable for use with a CNC bending device configured to carry out pre-programmed instructions to attain a desired bend. The CNC bending device may have multiple axis control to form multiple bends at various angles in a single tube arrangement 10 during a bending process.

Figure 4A:
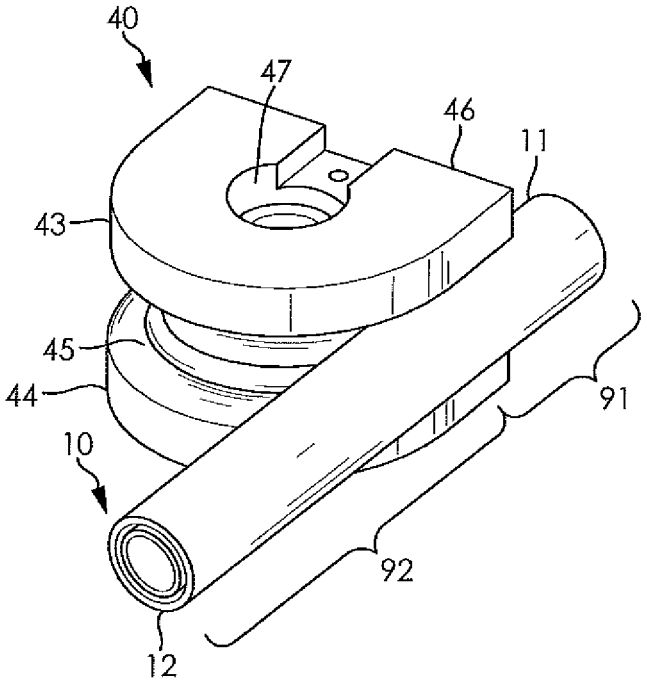
FIG. 4A is perspective view showing the tube arrangement located within a groove of the bending die.

To perform a bending process on the tube arrangement 10 using the bending die 40, the method according to the invention includes a step of locating 110 the tube arrangement 10 within the concave groove 45 of the bending die 40. The locating step 110 may include locating a first portion 91 of the length of the tube arrangement 10 within the linear portion 48 of the concave groove 45 while a second portion 92 of the length of the tube arrangement 10 extends beyond the linear portion 48 in a direction away from the back surface 46 of the bending die 40 and toward the curved portion 49 of the concave groove 45. The first portion 91 of the tube arrangement 10 represents a portion of the tube arrangement 10 that will not be deformed during the bending process. As shown in FIG. 4A, the first longitudinal end 11 of the tube arrangement 10 may extend beyond the back surface 46 of the bending die 40 during the locating step 110. It should be understood that the second portion 92 of the tube arrangement 10 extends from the concave groove 45 tangential to the linear portion 48 thereof, causing a widening gap to form between the second portion 92 of the tube arrangement 10 and the curved portion 49 of the concave groove 45 as the tube arrangement 10 extends away from the linear portion 48 of the concave groove 45.

In some cases, a further step 120 of clamping the first portion 91 of the tube arrangement 10 to the bending die 40 is required. The clamping step 120 may be carried out using a clamp die (not shown) that includes a linear groove formed therein having a substantially semi-circular cross-section and substantially the same diameter and radius of curvature as the concave groove 45. The concave groove 45 and the groove of the clamp die cooperate to surround and secure the first portion 91 of the tube arrangement 10 between the bending die 40 and the clamp die.

After the first portion 91 of the tube arrangement 10 is located within the concave groove 45 and is optionally clamped, the method according to the invention further includes a step 130 of applying force to the second portion 92 of the tube arrangement 10 in a direction toward the curved portion 49 of the concave groove 45. The force is initially applied to the second portion 92 of the tube arrangement 10 immediately adjacent the first portion 91 thereof and in a direction perpendicular to the longitudinal axis of the tube arrangement 10, causing the tube arrangement 10 to bend to conform to the curvature of the concave groove 45. An unbent portion of the tube arrangement 10 extends tangentially to the concave groove 45 as the tube arrangement 10 is bent around the curved portion 49 of the concave groove 45. The force is subsequently applied to the unbent portion of the tube arrangement 10 in a direction toward the concave groove 45 and perpendicular to the unbent portion of the tube arrangement 10 until a desired length of the tube arrangement 10 is bent around the curved portion 49 of the concave groove 45.

In the case of a bending device using a rotary draw bending process, the step 130 of applying force may be carried out using a pressure die (not shown). The pressure die may include a linear elongate groove formed therein having a semi-circular cross-section and a radius of curvature corresponding to that of the clamp die and the concave groove 45 for receiving a portion of the tube arrangement 10 therein. Prior to a bending process, the pressure die receives the second portion 92 of the tube arrangement 10 therein and the pressure die is disposed immediately adjacent the clamp die on a side of the tube arrangement 10 opposite the concave groove 45. The pressure die applies a force to the second portion 92 of the tube arrangement 10 in a direction toward the concave groove 45. While the pressure die applies the force to the second portion 92 of the tube arrangement 10, the bending die 40 may be caused to rotate about the aperture 47 while the first portion 91 of the tube arrangement 10 remains clamped between the clamping die and the linear portion 48 of the concave groove 45. The rotation of the bending die 40 causes the clamped first portion 91 of the tube arrangement 10 to rotate with the bending die 40, drawing the second portion 92 of the tube arrangement 10 around a portion of the concave groove 45. The force applied by the pressure die causes the second portion 92 of the tube arrangement 10 to bend and conform to the curved path of the concave groove 45. The pressure die may be caused to move linearly in unison with an unbent portion of the tube arrangement 10 as the clamped portion is drawn around the bending die 40. The bending die 40 is rotated until a desired bend has been formed in the tube arrangement 10.

Figure 4B:
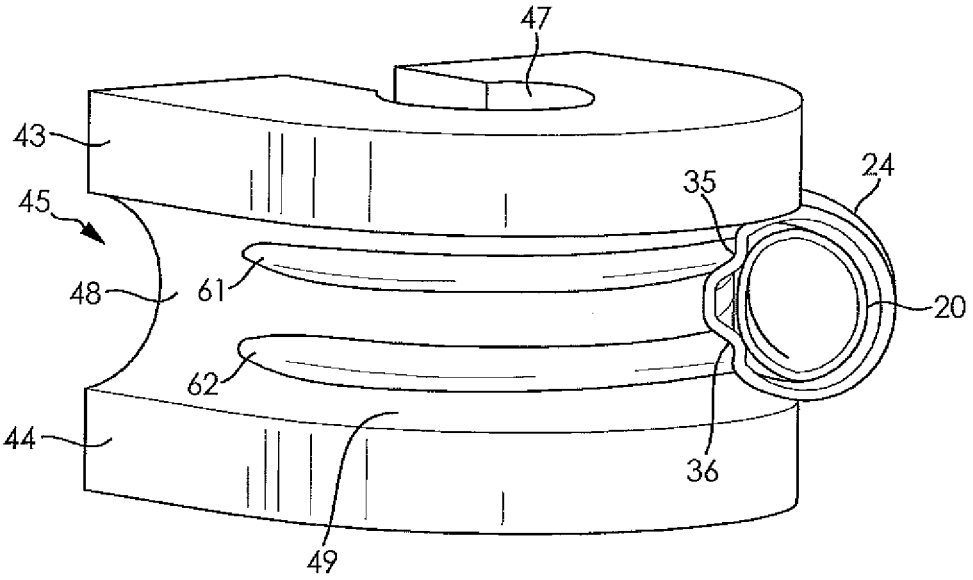
FIG. 4B is a cross-sectional view of the tube arrangement as it is bent around the bending die.

The method according to the invention includes a further step 140 of deforming the outer tube 24 to conform to the profile of the concave groove 45 having the first and second ridges 61, 62 formed therein as the tube arrangement 10 is forced against the concave groove 45. As shown in FIG. 4B, a first groove 35 corresponding to the first ridge 61 and a second groove 36 corresponding to the second ridge 62 are formed in the exterior surface 26 of the outer tube 24 due to the deformation thereof. The first groove 35 is formed in a first portion of the exterior surface 26 of the outer tube 24 and the second groove 36 is formed in a second portion of the exterior surface 26 of the outer tube 24. The first portion of the exterior surface 26 of the outer tube 24 corresponds to a portion of the outer tube 24 contacting the first surface 17 of the concave groove 45 while the second portion of the exterior surface 26 of the outer tube 24 corresponds to a portion of the outer tube 24 contacting the second surface 18 of the concave groove 45.

Figure 5:
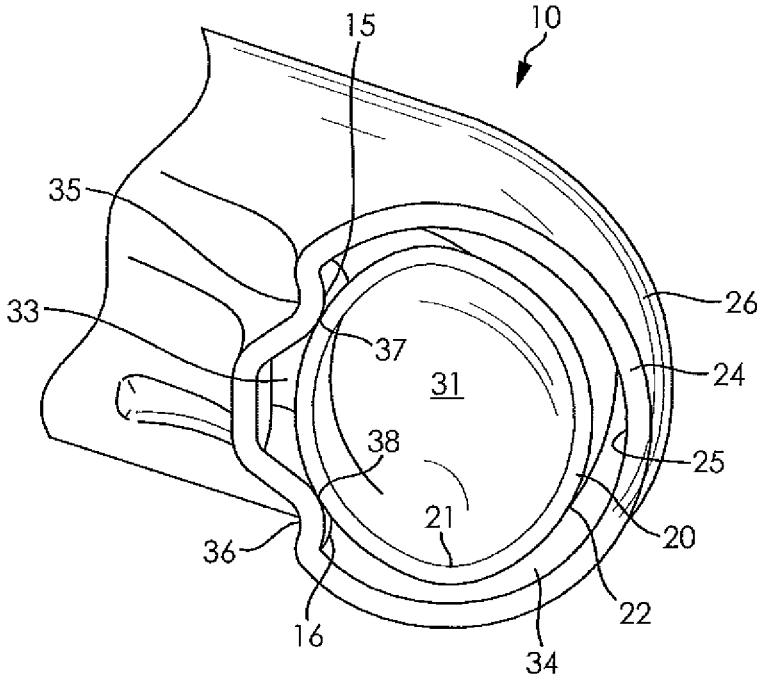
FIG. 5 is an enlarged fragmentary cross-sectional elevational view of the tube arrangement of FIG. 4B following a bending process.

Referring now to FIG. 5, the first groove 35 forms a first projection 15 on the interior surface 25 of the outer tube 24 while the second groove 36 forms a second projection 16 on the interior surface 25 of the outer tube 24. The first projection 15 contacts the exterior surface 22 of the inner tube 20 along a first contact region 37 while the second projection 16 contacts the exterior surface 22 of the inner tube 20 along a second contact region 38. The first and second contact regions 37, 38 extend along a length of the tube arrangement 10 engaging the first and second ridges 61, 62 of the concave groove 45 during the bending process. As shown in FIG. 4B, the inner tube 20 may also deform to be slightly elongate in a direction parallel to the first and second peripheral surfaces 43, 44 due to the cooperating contact of the first and second projections 15, 16, causing the inner tube 20 to have an elliptical cross-sectional shape.

The angle that each ridge 61, 62 projects from the concave groove 45 also affects the manner in which the outer tube 24 deforms to contact the inner tube 20. For instance, with reference to FIG. 4B, the first crest 66 and the second crest 76 each point in a direction generally toward a center of a cross-section of the inner tube 20. The first ridge 61 deforms the outer tube 24 to contact a portion of the exterior surface 22 of the inner tube 20 facing at least partially upwards and toward the first surface 41 of the bending die 40, causing a force applied by the first projection 15 at the first contact region 37 to have a downward component in a direction toward the second surface 42 of the bending die 40. The second ridge 62 deforms the outer tube 24 to contact a portion of the exterior surface 22 of the inner tube 20 facing at least partially downwards and toward the second surface 42 of the bending die 40, causing a force applied by the second projection 16 at the second contact region 38 to have an upward component in a direction toward the first surface 41 of the bending die 40. In cases where the first surface 17 and the second surface 18 of the concave groove 45 are symmetric, as shown in FIGS. 2B and 2C, the downward component of the force applied by the first projection 15 may substantially equal the upward component of the force applied by the second projection 16, preventing the inner tube 20 from being misaligned in an upward or downward direction within the outer tube 24. Furthermore, the symmetric relationship between the first surface 17 and the second surface 18 of the concave groove 45 prevents the inner tube 20 from being subjected to twisting about a longitudinal axis thereof when contacted by the first and second projections 15, 16.

The first and second ridges 61, 62 cooperate to deform the outer tube 24 in a manner that avoids a large area of contact between the interior surface 25 of the outer tube 24 and the exterior surface 22 of the inner tube 20. For instance, if only the first ridge 61 was formed within the concave groove 45, the outer tube 24 contacting the inner tube 20 may cause the inner tube 20 to be pressed toward the interior surface 25 of the outer tube 24 in a lower right corner of the cross-section of the tube arrangement 10 shown in FIG. 5, potentially causing the inner tube 20 to deform to contact a larger portion of the interior surface 21 of the inner tube 20. This larger area of contact is preferably avoided because it significantly restricts a portion of the second flow channel 32 while also presenting a possible source of noise due to vibration between the inner tube 20 and the outer tube 24 along the area of contact.

As best shown in FIG. 5, the deformation of the outer tube 24 to create the first and second contact regions 37, 38 causes the second flow channel 32 to be divided into at least a third flow channel 33 and a fourth flow channel 34. The third flow channel 33 is formed between the inner and outer tubes 20, 24 intermediate the first contact region 37 and the second contact region 38 while the fourth flow channel 34 is formed around a remainder of a circumference of the exterior surface 22 of the inner tube 20. Although the inner tube 20 may be elongated in a vertical direction after being deformed by the outer tube 24, there exists a slight clearance between the interior surface 25 of the outer tube 24 and the exterior surface 22 of the inner tube 20 at both an uppermost and a lowermost point of the inner and outer tubes 20, 24.

It should be understood that the method according to the invention is compatible with a concave groove 45 having ridges in addition to the first and second ridges 61, 62. For instance, the concave groove 45 may include a third ridge formed at the point B on the profile of the concave groove 45. The concave groove 45 may also include an even number of the ridges, where the first surface 17 of the concave groove 45 is symmetric to the second surface 18 of the concave groove 45. The concave groove 45 may also include a single ridge formed at the point B, as desired.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A method of forming a bend in a tube arrangement, the method comprising the steps of:

providing a tube arrangement including an inner tube disposed within an outer tube;

providing a bending die having a concave groove formed therein, the concave groove including a curved portion extending around a peripheral surface of the bending die, the curved portion of the concave groove having at least one ridge projecting therefrom;

locating at least a portion of the tube arrangement within the concave groove of the bending die;

applying force to the tube arrangement in a direction toward the concave groove of the bending die to cause the tube arrangement to bend around the curved portion of the concave groove; and deforming the outer tube of the tube arrangement, the deforming step including forming at least one groove in an exterior surface of the outer tube having a shape conforming to a shape of the at least one ridge projecting from the curved portion of the concave groove, wherein the at least one groove formed in the exterior surface of the outer tube causes at least one projection to be formed on an interior surface of the outer tube, wherein the at least one projection contacts an exterior surface of the inner tube.

2. The method of claim 1, wherein the concave groove of the bending die includes a first ridge and a second ridge projecting from the curved portion thereof.

3. The method according to claim 2, wherein the concave groove has a substantially semi-circular profile as it extends around the peripheral surface of the bending die.

4. The method according to claim 3, wherein the first ridge is formed on a first surface of the concave groove and the second ridge is formed on a second surface of the concave groove, wherein the first surface extends along a first half of the semi-circular profile of the concave groove and the second surface extends along a second half of the semi-circular profile of the concave groove.

5. The method according to claim 2, wherein the first ridge includes a first crest and the second ridge includes a second crest, wherein each of the first crest and the second crest point in a direction toward a center of a cross-section of the tube arrangement as the tube arrangement is bent around the concave groove of the bending die.

6. The method according to claim 1, wherein the concave groove of the bending die includes a first ridge and a second ridge projecting from the curved portion thereof, and wherein the deforming of the outer tube causes a first groove to be formed in the exterior surface of the outer tube and a second groove to be formed in the exterior surface of the outer tube.

7. The method according to claim 6, wherein the forming of the first groove causes a corresponding first projection to be formed on an interior surface of the outer tube and the forming of the second groove causes a corresponding second projection to be formed on the interior surface of the outer tube.

8. The method according to claim 7, wherein the first projection and the second projection cooperate to secure a position of the inner tube relative to the outer tube.

9. The method according to claim 1, wherein the step of applying the force to the tube arrangement is performed using a pressure die in a rotary draw bending process.

10. The method according to claim 1, further including a step of clamping the at least a portion of the tube arrangement located within the concave groove to the bending die.

11. A method of bending a tube arrangement around a bending die, the method comprising the steps of:

providing a bending die having a concave groove formed therein, the concave groove including a curved portion having at least one ridge projecting therefrom;

providing a tube arrangement having an inner tube disposed within an outer tube; and deforming the outer tube of the tube arrangement, the deforming step including forming at least one groove in an exterior surface of the outer tube having a shape conforming to a shape of the at least one ridge projecting from the curved portion of the concave groove, wherein the at least one groove formed in the exterior surface of the outer tube causes at least one projection to be formed on an interior surface of the outer tube, wherein the at least one projection contacts an exterior surface of the inner tube.

12. The method according to claim 11, wherein the concave groove has a semi-circular profile.

13. The method according to claim 12, wherein the concave groove includes a first ridge projecting from a first surface of the concave groove and a second ridge projecting from a second surface of the concave groove, wherein the first surface extends along a first half of the semi-circular profile of the concave groove and the second surface extends along a second half of the semi-circular profile of the concave groove.

14. The method according to claim 11, wherein the contacting of the interior surface of the outer tube to the exterior surface of the inner tube secures a position of the inner tube within the outer tube.

* * * * *